US005205472A

United States Patent [19]

Sullivan

[11] Patent Number: 5,205,472

[45] Date of Patent: * Apr. 27, 1993

[54] FAN COIL UNIT

[76] Inventor: John T. Sullivan, 3910 Madison St., Hyattsville, Md. 20781

[ * ] Notice: The portion of the term of this patent subsequent to Jul. 21, 2009 has been disclaimed.

[21] Appl. No.: 857,368

[22] Filed: Mar. 25, 1992

Related U.S. Application Data

[62] Division of Ser. No. 642,767, Jan. 18, 1991, Pat. No. 5,113,667.

[51] Int. Cl.[5] ..... B65D 25/18

[52] U.S. Cl. ..... 220/571; 220/600; 220/694

[58] Field of Search ..... 220/571, 600, 694, 476, 220/628, 604, 605, 606

[56] References Cited

U.S. PATENT DOCUMENTS 4,856,672 8/1989 Sullivan ..... 220/571

5,131,560 7/1992 Sullivan ..... 220/571

*Primary Examiner*—Joseph Man-Fu Moy

*Attorney, Agent, or Firm*—Diller, Ramik & Wight

[57] ABSTRACT

A fan coil unit which includes a primary pan disposed in a housing and setting-off therewith opposite first and second chamber portions housing a condensation coil and a fan, respectively; an air passage is provided in the primary pan through which air is directed by the fan whereby condensation formed upon the coil will collect in the primary pan, a series of bolts pass through holes in the primary pan and a bracket for the fan motor to secure the fan motor and an associated fan housing to an underside of the primary pan, each bolt includes a head within the primary pan which would otherwise be subject to the adverse effects of condensation, but the cap in this case is covered by a cover cross bonded in a water-tight fashion to the primary pan thereby preventing condensation from adversely affecting the bolts or equivalent fasteners.

12 Claims, 9 Drawing Sheets

FIG. 3
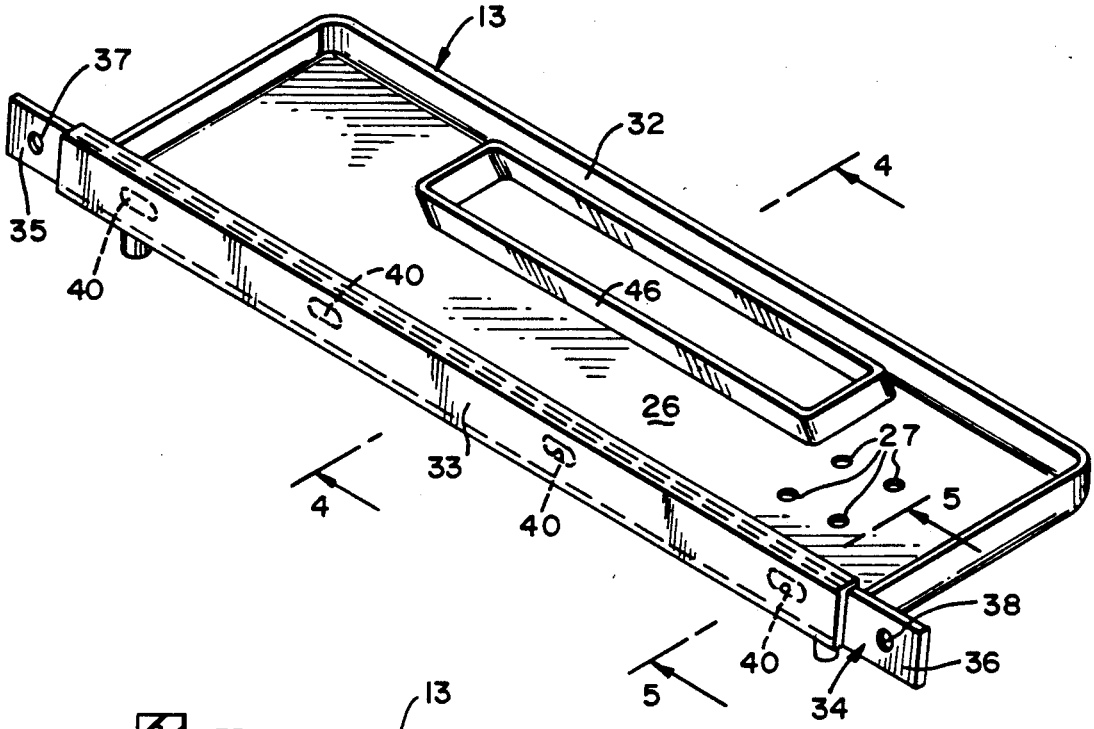
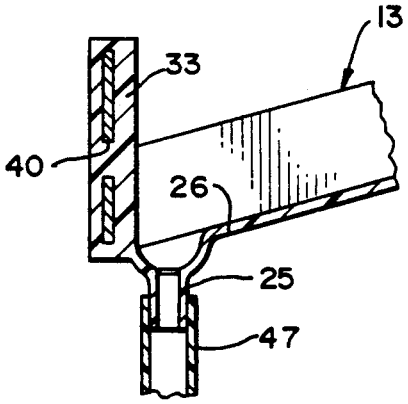
FIG. 5
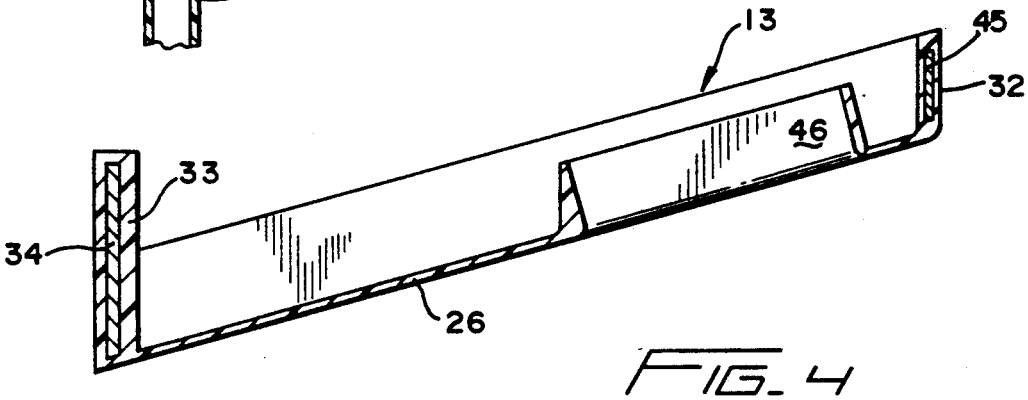
FIG. 4

FIG_7
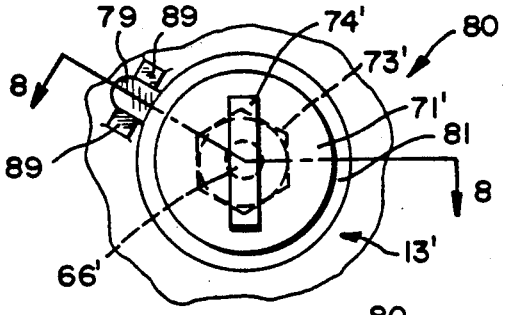
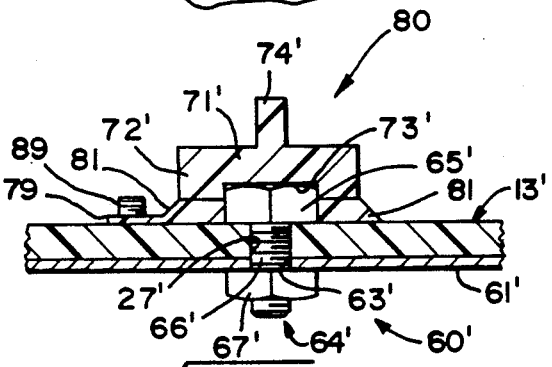
FIG_8
FIG_9
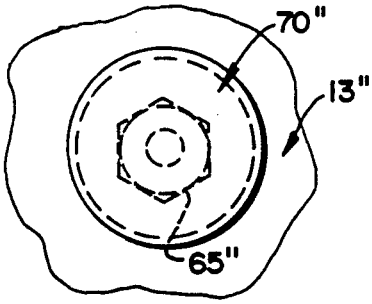
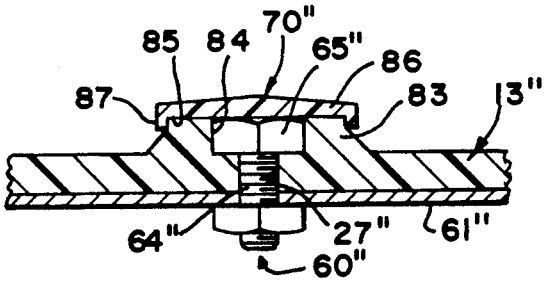
FIG_10
FIG_11
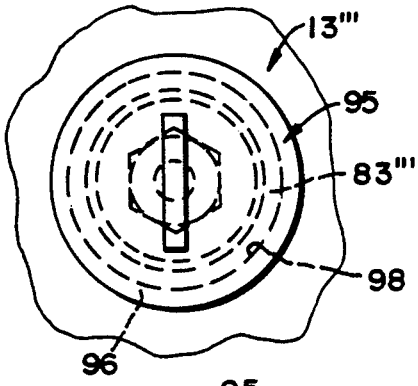
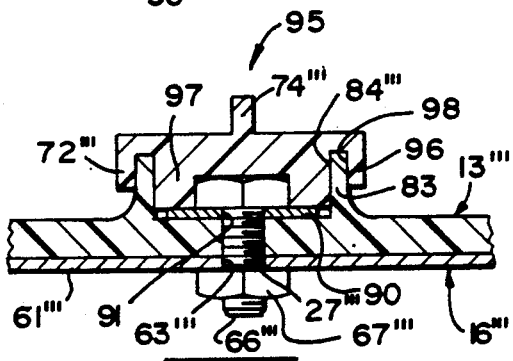
FIG_12

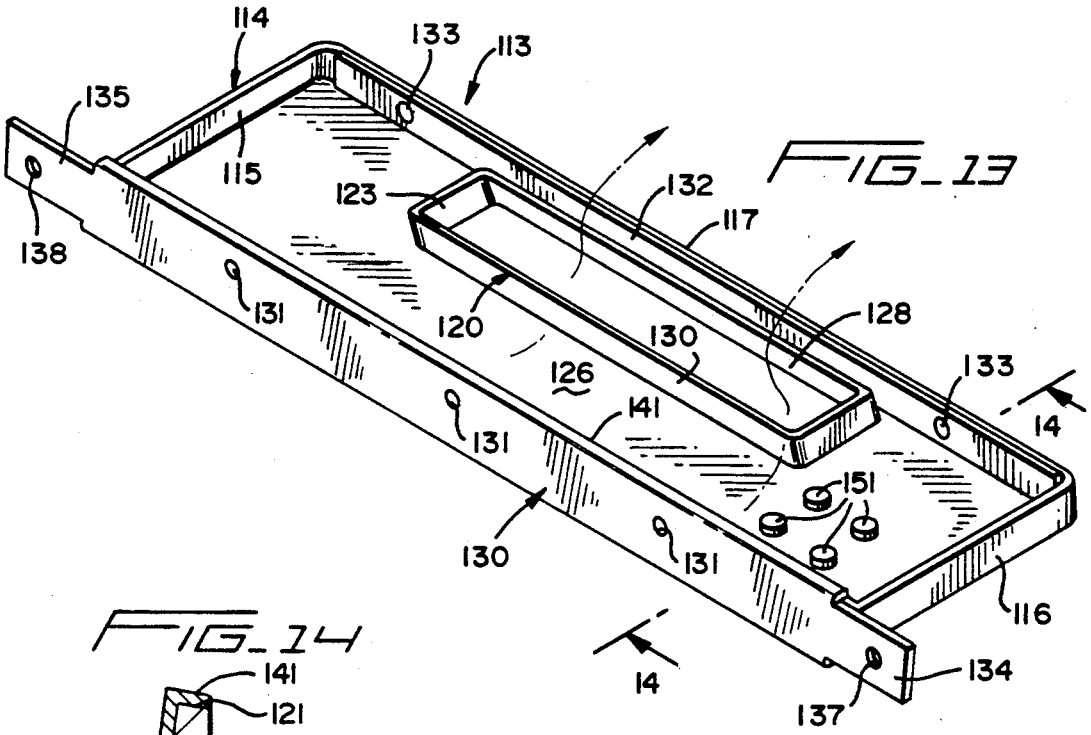
FIG_13
FIG_14
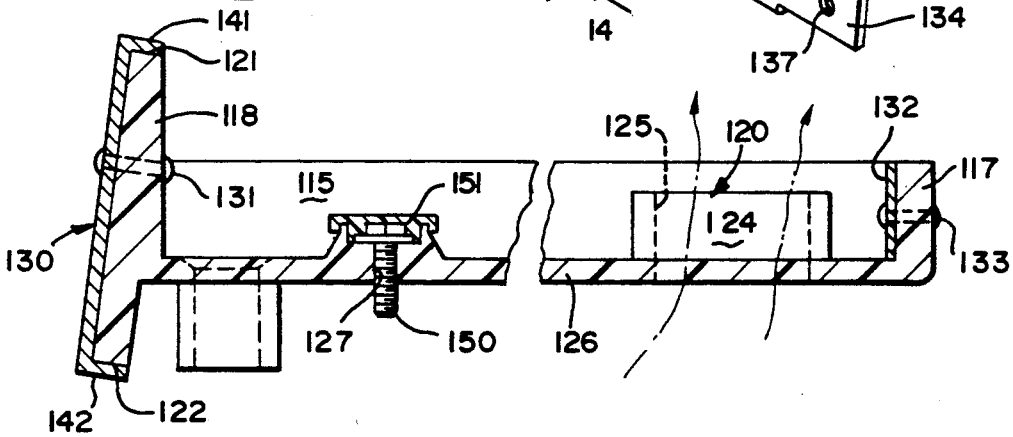
FIG_15
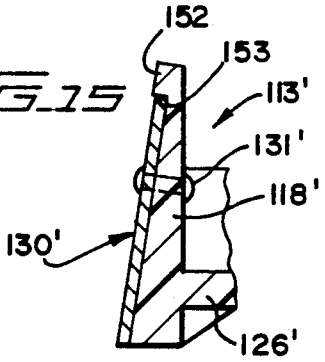
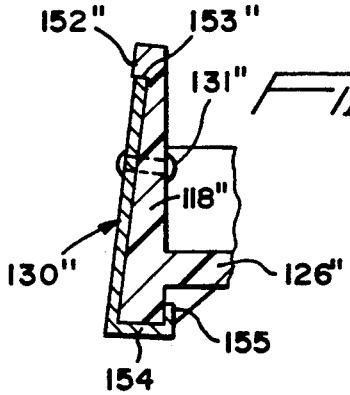
FIG_16

FIG_18
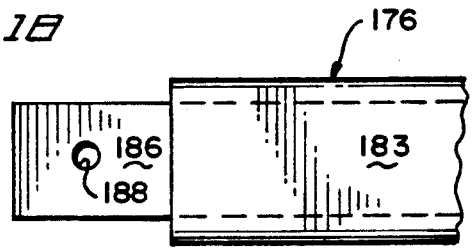
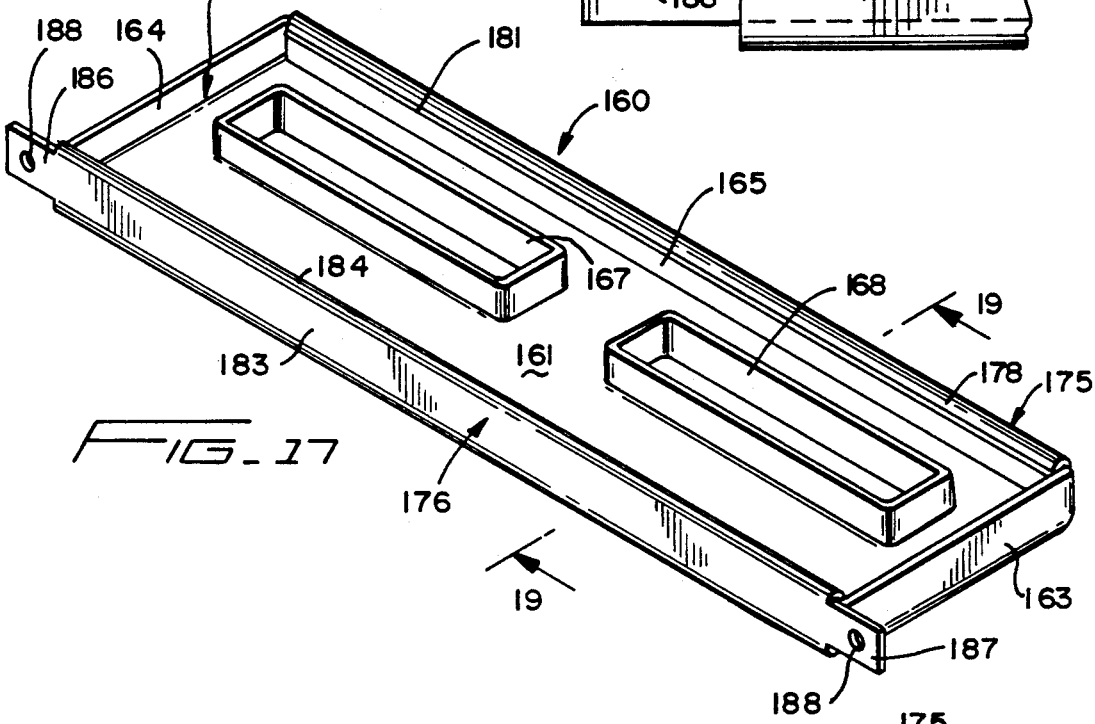
FIG_17
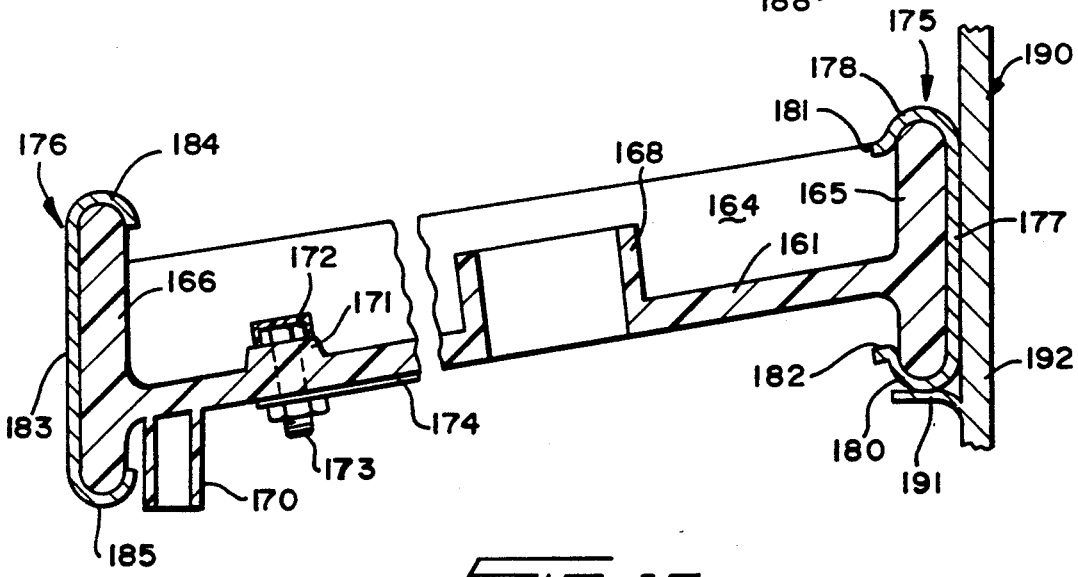
FIG_19

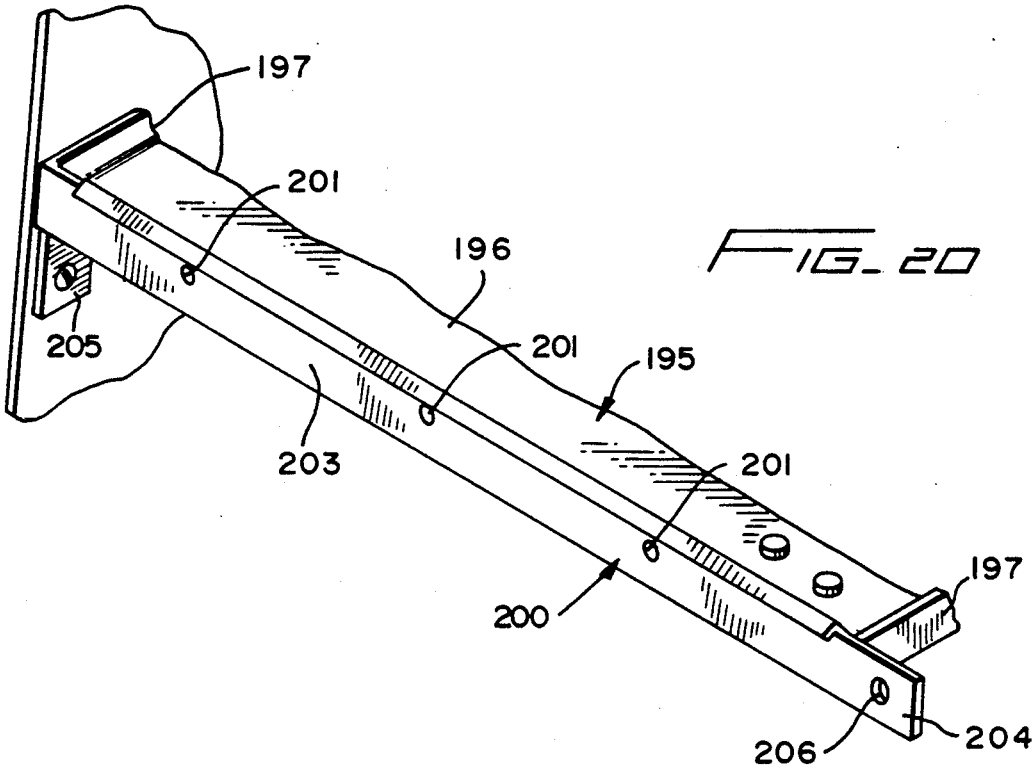
FIG. 20
FIG. 21
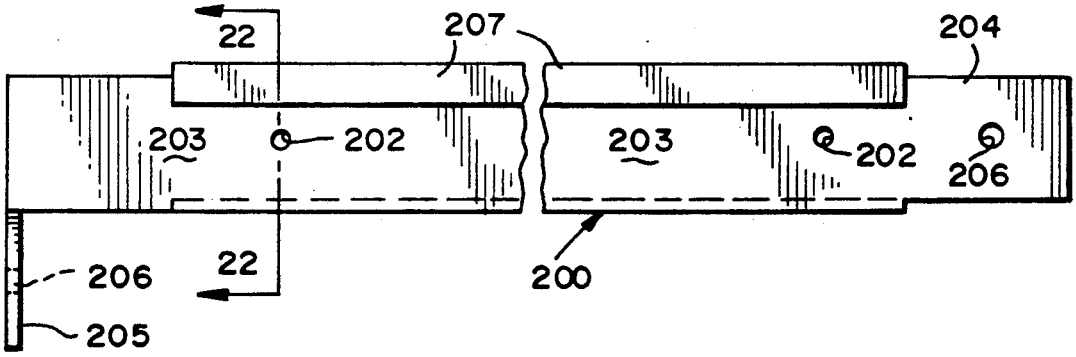
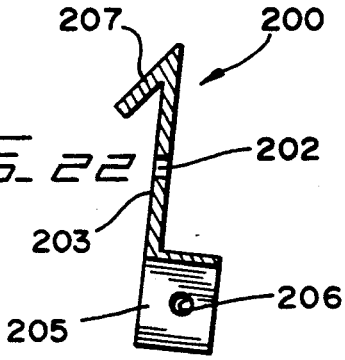
FIG. 22

FAN COIL UNIT

This application is a continuation of application Ser. No. 07/642,767, filed Jan. 18, 1991 and now U.S. Pat. No. 5,113,667.

CROSS-REFERENCE TO RELATED APPLICATIONS

This invention is directed to a fan coil unit for commercial and residential air conditioners which can utilize a primary pan or convector tray of the type disclosed in U.S. Pat. No. 4,856,672 granted on Aug. 15, 1989 entitled CONDENSATION PAN/CONVECTOR TRAY FOR A FAN COIL UNIT and application Ser. No. 07/444,267 filed on Dec. 1, 1989, entitled A FAN COIL UNIT, both in the name of John T. Sullivan.

BACKGROUND OF THE INVENTION

Residential and commercial air conditioners include as a part thereof a fan coil unit located within a housing which includes a coil through which refrigerant (liquid or gas, such as freon) is pumped. The coil is normally supported above a condensation pan, convector tray or primary pan having one or more openings through which air is blown by one or more fans powered by motors which are supported below and from the primary pan. The air passing through the coil creates condensation on the coil which drips down upon and into the primary pan and is then conducted by an appropriate outlet through a discharge pipe to a secondary pan and/or an associated drain.

Such conventional primary pans are generally made from galvanized metal and rust with relative ease. The fasteners (nuts and bolts and/or rivets) which connect the fan and/or fan housings to the primary pan are also generally made from metal and rust with equal relative ease. Once the primary pan and/or the fasteners rust, the condensation/water normally accumulating therein and draining properly therefrom, cannot do so. Instead the condensation can, for example, drip through the rusted galvanized primary pan and/or the fasteners into the underlying motor(s) which drives the fan(s) thereby causing the motor to short-out. The fan motor itself is normally supported by a metallic bracket and excessive rusting of the primary pans/metal fasteners will cause the fan support brackets to rust. Excessive rusting coupled with the centrifugal force of the fan motor would cause wobble, undesirable increased noise, and could eventually result in the brackets breaking or sufficiently loosening such that the motors and fans simply fall from the primary pan.

Excessive rust also blocks or reduces normal drainage which results in fungus growth, and fungus growth in turn can cause odors. Should such fungus growth cause the normal drain opening of the primary pan to close or to become appreciably blocked, the water/condensation will overflow with attendant damage.

The latter-identified patent and pending patent application reduce rust and fungus growth associated with conventional galvanized metal primary pans. The latter disclosures also provide an obvious solution to rubber gasket deterioration associated with conventional primary pans. Primary pan reinforcement, motor mounts and fan housing mounts are also set forth in the latter-identified disclosures.

SUMMARY OF THE INVENTION

The present invention is directed to additional novel and innovative structural aspects of a fan coil unit which overcomes the disadvantages heretofore noted by not only providing a primary pan constructed from in situ molded polymeric/copolymeric material, but also providing in association therewith novel connecting or fastening means for connecting the primary pan to the fan housing and/or fan housing bracket and the associated fan in such a manner as to prevent rust, deterioration and/or fungus growth.

In a preferred embodiment of the invention, a primary pan is located in a chamber of a fan coil unit housing and sets-off therewith opposite first and second chamber portions. A condensation coil is located in the first chamber portion, and a fan is located in the second chamber portion. An air passage is located in the primary pan through which air is directed by the fan from the second chamber portion into the first chamber portion whereby condensation formed upon the coil will collect in the primary pan. In accordance with the invention, fastening means, such as metal nuts and bolts, pass through openings in the primary pan and the heads of the bolts are covered by a cover with each cover being bonded to the polymeric primary pan. The covers in the primary pan are made of polymeric/copolymeric material and when bonded to each other, condensation which collects in the primary pan cannot attack the metal fasteners (bolts and/or nuts), and the deterioration thereof is thereby precluded. Obviously the latter assures reliable operation and long life of the primary pan, the motor housing and the fan housing mountings.

In further accordance with the present invention, the construction of the protective covers or caps may vary, but at a minimum, each includes at least an end wall and a peripheral wall depending therefrom. The end wall and peripheral wall collectively define a cavity and it is within the cavity that the head of each fastener (or nut) is housed. Each peripheral wall is bonded to an interior surface of the primary pan in a water-tight fashion thereby precluding condensation from attacking the fastener heads (or nuts) located within the cover cavity.

In further accordance with the invention, reinforcing means in the form of a washer is positioned between the head of the bolt or the nut on the inside of the primary pan to dissipate load and thereby increase the rigidity of each connection. Preferably the peripheral wall of each cover terminates in a very thin radially outwardly directed peripheral flange or lip which, because of its thinness and the bonding material/adhesive, cross-bonds readily and rapidly to the interior surface of the primary pan. Any adhesive which cross-links or cross-bonds synthetic polymeric/copolymeric material will suffice in keeping with the present invention, such as KRAZY GLUE distributed by Krazy Glue, a division of Jadow & Sons, Inc., N.Y. 10010.

In further accordance with this invention, the primary pan, condensation pan or convector tray and/or the caps or covers utilized to cover the fasteners are not only preferably molded from polymeric/copolymeric material to prevent or lessen fungus growth, as compared to galvanized metal pans, but, preferably, during the molding, the hot plastic is admixed with preservatives which function to protect polymeric material from attack by microorganisms. Microbiological attack of the polymer can lead to the loss of aesthetic appearance, mildew, odors, embrittlement, and premature product failure. Of several different preservative additives for polymeric materials, the preferred are: 2-n-octyl-r-isothiazolin-3-one and 10,10'bisphenoxarsine.

With the above, and other objects in view that will hereinafter appear, the nature of the invention will be more clearly understood by reference to the following detailed description, the appended claims and the several views illustrated in the accompanying drawings.

BRIEF DESCRIPTION OF THE DRAWINGS

FIG. 3 is an enlarged top perspective view of the primary pan of FIG. 1, and illustrates an in situ molded metallic reinforcing bar having exposed mounting ends and four holes for securing the fan motor to a bottom wall of the primary pan.

FIG. 4 is a cross sectional view taken generally along line 4—4 of FIG. 3, and illustrates details of the reinforcing and/or mounting bar of the primary pan.

FIG. 5 is a cross sectional view taken generally along line 5—5 of FIG. 3, and illustrates the manner in which holes in the reinforcing/mounting bar are bridged by material of the primary pan during the injection molding thereof.

FIG. 2, is a cross sectional view taken generally along line 6—6 of FIG. 2, and illustrates a cover or cap formed of a polymeric material encasing the head of a metallic bolt which fastens a fan motor to a bottom wall of the primary pan.

FIG. 7 is a top plan view of another cap or cover constructed in accordance with this invention, and illustrates a generally hexagonal cavity in the cover and a peripheral sealing lip thereof.

FIG. 8 is an axial cross sectional view taken generally along line 8—8 of FIG. 7, and illustrates a head of a metallic bolt housed within the cavity of the cap.

FIG. 9 is a fragmentary top plan view of another cap of the present invention, and illustrates the same covering a bolt head.

FIG. 10 is a cross sectional view taken generally along line 10—10 of FIG. 9, and illustrates the manner in which a peripheral wall of the cap is in external telescopic relationship to an upstanding boss of the primary pan.

FIG. 11 is a top plan view of another cap constructed in accordance with this invention, and illustrates the same in overlying relationship to an associated fastener.

FIG. 12 is a cross sectional view taken generally along line 12—12 of FIG. 11, and illustrates the cap provided with internal and external peripheral walls defining a peripheral groove therebetween into which is received an upstanding peripheral wall of the primary pan.

FIG. 13 is an enlarged top perspective view of another primary pan of this invention, and illustrates two metallic reinforcing bars riveted to an upstanding peripheral wall of the pan and four caps covering heads of fasteners which secure a fan motor to a bottom wall of the primary pan.

FIG. 14 is an enlarged fragmentary cross sectional view taken generally along line 14—14 of FIG. 13, and illustrates the two metallic reinforcing bars and one of the caps and fasteners.

FIG. 15 is a fragmentary cross sectional view of a portion of another primary pan similar to that illustrated in FIG. 4, and illustrates a peripheral wall of the pan overlying an edge of an associated reinforcing bar.

FIG. 16 is a fragmentary cross sectional view of another primary pan similar to that illustrated in FIG. 14, and illustrates another reinforcing bar having an upper edge in sealing contact with a peripheral wall of the primary pan and a lower edge encapsulating a lower leg of the primary pan peripheral wall.

FIG. 17 is a top perspective view of another primary pan of this invention, and illustrates two reinforcing bars secured to opposite upstanding walls of the pan.

FIG. 18 is an enlarged fragmentary view of the end of one of the reinforcing bars, and illustrates a fastener receiving opening thereof.

FIG. 19 is an enlarged fragmentary cross sectional view taken generally along lines 19—19 of FIG. 17, and illustrates the manner in which the metallic reinforcing bars are secured to the associated walls.

FIG. 20 is a fragmentary perspective view of another primary pan of this invention, and illustrates a metallic reinforcing bar riveted thereto and having mounting flanges at opposite ends.

FIG. 21 is a side elevational view of the metallic reinforcing bar of FIG. 20, and illustrates the mounting flanges disposed generally normal to each other.

FIG. 22 is a cross sectional view taken generally along line 22—22 of FIG. 21, and illustrates a portion of the metallic reinforcing bar folded upon itself to effect further rigidity thereof.

DESCRIPTION OF THE PREFERRED EMBODIMENT

Figure 1:
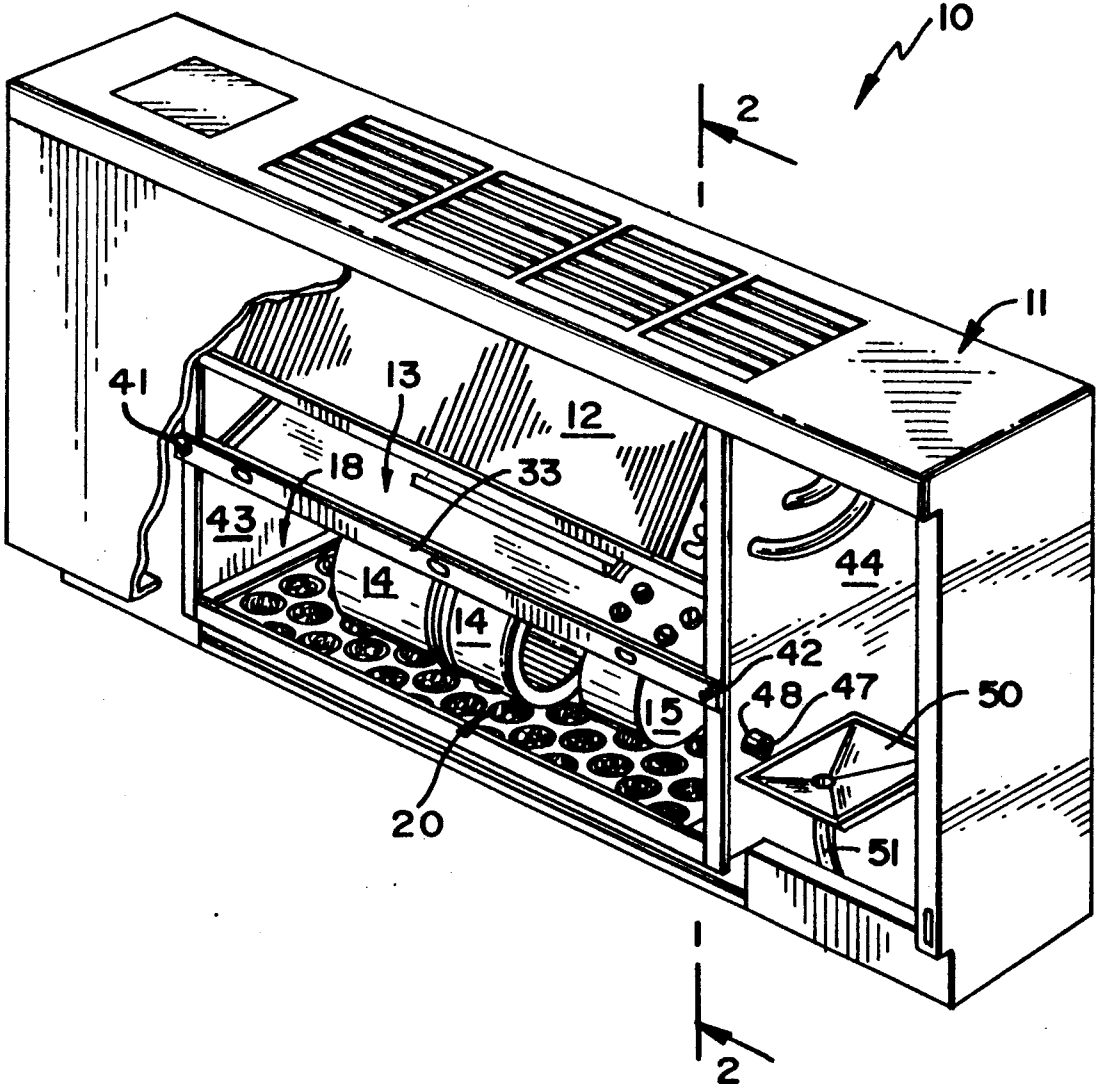
FIG. 1 is a top perspective view of a fan coil unit with a front wall thereof broken away for clarity, and illustrates a housing defining a chamber, a primary pan in the chamber, a coil above the primary pan and a motor and fan/fan housing unit below and secured to the primary pan.
Figure 2:
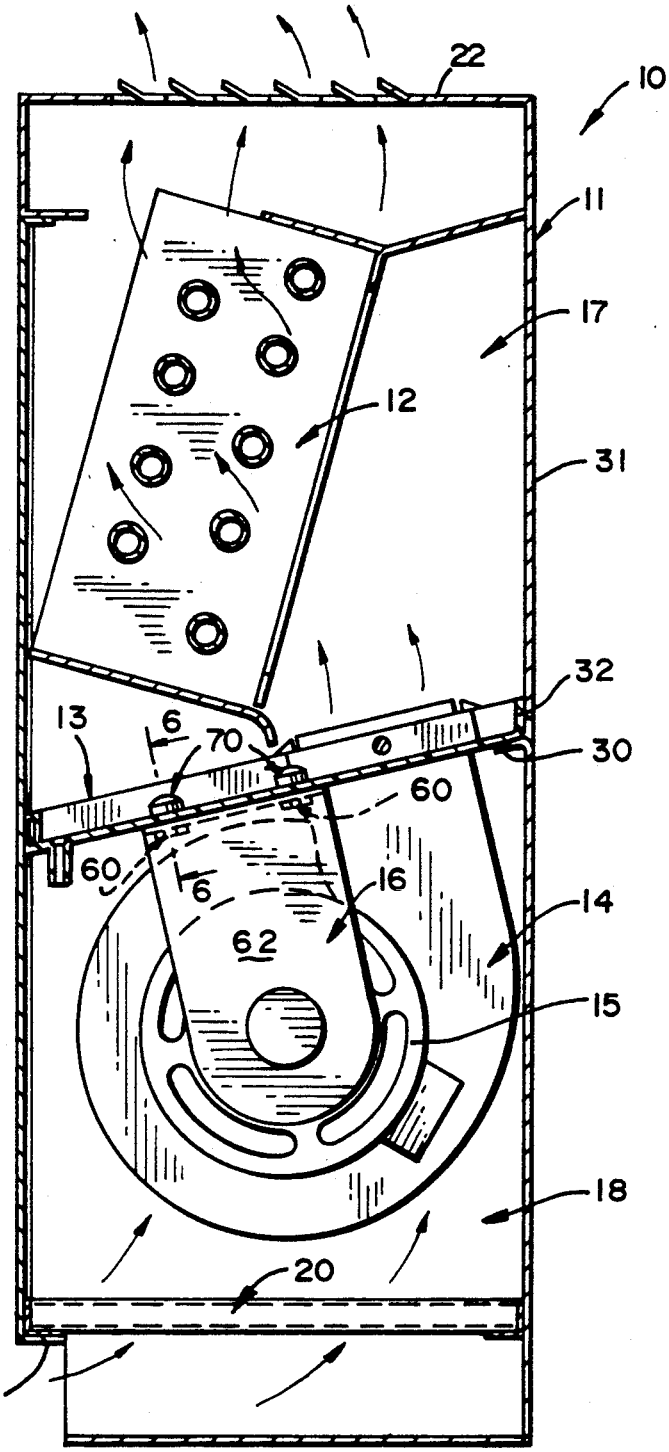
FIG. 2 is an enlarged cross sectional view taken generally along line 2—2 of FIG. 1, and illustrates details of the coil, primary pan, fan housing, motor housing and motor mounting bracket and its associated fasteners.

A novel fan coil unit of the present invention is illustrated in FIGS. 1 and 2 of the drawings and is generally designated by the reference numeral 10. The fan coil unit 10 includes a housing 11, a condensation/evaporation coil 12, a primary pan, condensation pan or convector tray 13, a fan housing 14, a fan motor 15 and a fan motor mounting bracket 16.

The housing 11 defines a chamber (unnumbered) which is divided into a first or upper chamber portion 17 and a second or lower chamber portion 18 by the primary pan 13, as is best illustrated in FIG. 2. A conventional filter 20 spans an opening (unnumbered) formed in a bottom wall 21 (FIG. 2) of the housing 11 while a top wall 22 includes a plurality of grates or openings (unnumbered). When the fan motor 15 is energized, air is drawn from the exterior through the bottom wall 21, the filter 20, into and through the fan housing 14 and an opening 24 (FIG. 3) of the primary pan 13 and through the coils 12 and the openings (unnumbered) of the top wall 22 (as indicated by the unnumbered headed arrows in FIG. 2). As air passes through the condensation/evaporator coil 12, water condenses from the air and drips into the pan 13 from which it exits through a discharge port 25 (FIG. 5) projecting from a bottom wall 26 of the primary pan 13. The bottom wall 26 also has four circular holes 27 (FIG. 3) for securing the fan motor mounting bracket 16 thereto in a manner which will be described more fully hereinafter.

A plurality of lips or flanges 30 (FIG. 2) are struck from the material of a back wall 31 of the housing 11 and are bent inwardly slightly at an incline and support thereon the bottom wall 26 of the primary pan 13 along an upstanding wall 32 thereof. Another upstanding wall 33 (FIGS. 3-5) of the primary pan 13 carries a rigid metal mounting/reinforcing bar 34 having opposite ends 35, 36 (FIG. 3) each having an opening 37, 38, respectively. The bar 34 is placed in a mold into which plastic material is injected and thus is in situ molded in and entirely encapsulated by the polymeric/copolymeric material of the upstanding wall 33, as is best illustrated in FIG. 5. Preferably the bar 34 has a plurality of oval-shaped openings 40 spaced along the length thereof (four such openings being shown in FIG. 3) through which the plastic material bridges and thus additionally rigidifies and unites the bar 34 to the upstanding wall 33. Fasteners 41, 42 (FIG. 1) are passed through the respective openings 37, 38 and are threaded into openings (not shown) of upstanding plates 43, 44 of the housing 11 (FIG. 1). Thus, by removing the two fasteners or sheet metal screws 41, 42, the primary pan 13 together with the fan housing 14, the fan motor 15 and the fan motor mounting bracket 16 can be readily inserted into and withdrawn from the housing 11.

The upstanding wall 32 also has in situ molded therein a reinforcing bar 45 (FIG. 4), but the latter is devoid of exposed ends, such as the ends 35, 36 of the bar 34, because the upstanding wall 32 bridges and is reinforced by the brackets or flanges 30 struck and bent from the rear wall 31 of the housing 11 (FIG. 2). The fan housing 14 is also snap-secured into a generally rectangularly contoured upstanding peripheral wall 46 (FIG. 3) of the primary pan 13 in the manner described in the latter-identified disclosures which is incorporated hereat by reference. The drain pipe 25 (FIG. 5) of the primary pan 13 is connected to a drain tube 47 of plastic material which passes through an opening 48 (FIG. 1) adjacent and above a secondary drain pan 50 which in turn has a drain tube 51 connected to an outside drain. Thus, condensation collected in the primary pan 13 flows through the outlet 25, the drain tube 47 into the secondary pan 50 and from the latter via the drain tube 51 into a conventional drain.

Figure 6:
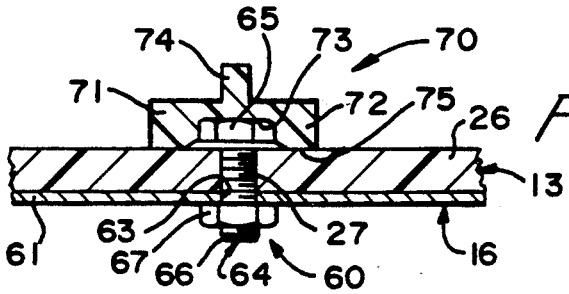
FIG. 6, which appears on the sheet of drawing containing

Reference is made specifically to FIGS. 2 and 6 of the drawings which illustrate means 60 for fastening the fan motor mounting bracket 16 to the bottom wall 26 of the primary pan 13 and means 70 for covering the fastening means 60 interiorly of the primary pan 13 and preventing condensation from adversely affecting the fastening means 60.

The fan motor mounting bracket 16 is of a generally inverted U-shaped configuration, as illustrated in the aforementioned disclosures, and includes a bight portion or web 61 and a pair of depending generally parallel spaced walls 62, only one of which is shown in FIG. 2. The web 61 is provided with four holes 63 (only one of which is illustrated) each corresponding to and aligned with one of the associated holes 27 in the bottom wall 26 of the primary pan 13 (FIG. 3). The holes 63, 27 are aligned and fasteners 64 of the fastening means 60 in the form of bolts having hexagonal heads 65 and threaded stems 66 are passed through these openings and are secured thereto by threaded nuts 67. The nuts 67 and bolts 64 are made of galvanized or similar metallic material, and unless otherwise protected by the cover 70 would be opposed to the corrosive effect of the condensation within the primary pan 13. However, the covers 70 preclude condensation from adversely affecting the fastening means by totally encapsulating and covering the fastening means 60 and particularly the bolt heads 65 in a water tight and bonded fashion.

Each of the covers 70 includes an end wall 71 and a peripheral wall or skirt 72 defining an interior downwardly opening cavity contoured to the configuration of the bolt head 65. An axial wall 74 projects from the end wall 71 in a direction opposite to that of the projection of the peripheral wall 72. The axial wall 74 is so shaped to allow machine insertion or manual insertion of each cover over and upon each bolt head 65 after the peripheral wall 72 and particularly an end face 75 thereof has been dipped into an adhesive which cross-bonds with an interior surface (unnumbered) of the bottom wall 26. Thus either the machine or the hands of a worker will not be adversely affected by the caustic nature of the adhesive when the flange 75 is appropriately gripped and manipulated and is, of course, free of such an adhesive. When the cross-bonding occurs between the end face 75 and the primary pan 13, the seal is water tight and condensation cannot reach and thus adversely affect any of the bolts 64 or the underlying nut 67 or the web 61 of the fan motor mounting bracket 16. Thus, even if condensation may back up in the inclined primary pan 13 (FIG. 2) to the extent that the covers 70 are even covered by condensation, the water/condensation still cannot adversely affect the fastening means 60. In this manner the longevity of the connection between the fan motor mounting bracket 16 and the primary pan 13 is extended appreciably.

Reference is now made to FIGS. 7 and 8 of the drawings in which structure corresponding to that illustrated in the earlier figures has been identically numbered and primed, such as a primary pan 13', one of four openings 27', fastening means 60' in the form of a bolt 64' including a head 65' and a stem 66' passing through the opening 27' and an opening 63' of a web 61' of a fan motor mounting bracket 16' which are all secured together by a nut 67'. However, in lieu of the cover, closure or cap 70 of FIG. 6, a closure, cover or cap 80 is provided which includes a flange 74', an end wall 71' and a peripheral wall 72' collectively defining a hexagonal cavity 73' which matches the hexagonal flats of the head 65'. A lower end portion of the peripheral wall 72' is radially outwardly flared and terminates in a tapering peripheral sealing lip 81 which is relatively thin at its maximum radially most outboard edge. At one portion projecting radially from the sealing lip 81 is a tab 79 and projecting up from a bottom wall 26' are two spaced integral stops or stop lugs 89, 89. The cap 80 is positioned with the head 65' of the bolt 64' within the recess 73' and with the tab 79 between and in abutment with the stops 89, 89. When thus positioned the nut 67' is torqued home and the clockwise force tending to rotate the bolt 64' is resisted by the contact between the tab 79 and one of the stops 89, as is readily apparent from FIG. 7 in which an unnumbered headed arrow has been illustrated to indicate the torque direction. Opposite rotation imparted to the nut 67' will prevent the cap 80 from rotating counterclockwise because of the contact of the tab 79 with the other of the stops 89. Therefore, irrespective of the direction of rotation of the nut 67', the cap 80 will not rotate. Preferably an adhesive is applied to the sealing lip 81 after the tab 79 has been placed between the lugs 89, 89 and before the nut 67' is torqued in either direction. The adhesive bond between the sealing lip 81 and the bottom wall 26' might be broken if it were not for the abutment between the tab 79 and the stops 89, 89, and thus the latter elements assure a hermetic seal by preventing fracture of the bond between the lip 81 and the bottom wall 26'. In this manner the inner surface (unnumbered) of the primary pan 13' forms a water-tight seal between the lip 81 and the primary pan 13' to prevent condensation from adversely affecting the fastening means 60'.

In FIGS. 9 and 10 of the drawings structure identical to that heretofore described has been double primed, and in this case a boss 83 rises inwardly of the primary pan 13'' at each opening 27'' which is counterbored at 84 to the configuration of the head 65'' of the bolt 64''. Therefore, in this case the boss 83 includes the cavity 84 contoured to the polygonal/hexagonal configuration of the bolt head 65' whereas a cavity 85 defined between an end wall 86 and a peripheral wall 87 of the cap or closure 70'' is cylindrical. Both the peripheral and axial surfaces (unnumbered) of the cap or cover 70' and the boss 83 are cross bonded to each other to form a hermetic seal and prevent condensation in the primary pan 13'' from adversely affecting the fastening means 60''.

In FIGS. 11 and 12 of the drawings identical structure bears identical reference numerals to the structure earlier described except the same has been triple primed. In this case a primary pan 13''' includes an upstanding boss 83''' which in turn defines an internal cylindrical cavity 84''' housing a rigidifying and load dissipating metallic washer 90 having a circular opening 91 aligned with openings 27''' and 63''' of the primary pan 13''' and the web 61''' of the fan mounting bracket 16'''.

The cover or cap 95 includes an axial flange 74''' projecting in a direction opposite to that of a peripheral wall 72'''. The peripheral wall 72''' is defined by an outer peripheral wall or skirt 96, an inner peripheral wall or skirt 97 and a peripheral groove or channel 98 therebetween. A recess or cavity 99 is contoured to the configuration of the head 65''' of the bolt 64'''. In this case all axial and peripheral surfaces of the boss 83''', the wall portions 96, 97 and the end wall 71''' are adhesively bonded to each other to essentially define three water-tight seals which are located at the cross bonding planes or surfaces defining the inner and outer peripheral walls and the axial wall (unnumbered) of the boss 83'''.

Reference is made to FIGS. 13 and 14 of the drawings which illustrate another primary pan, condensation pan, or convector tray designated by the reference numeral 113. The primary pan 113 includes a bottom wall 126 having four openings 127 (FIG. 14) of which only one is illustrated. The primary pan 113 includes a generally upstanding outboard peripheral wall 114 and an inboard upstanding peripheral wall 120 which defines an opening 125 through which air flows in the manner indicated by the unnumbered headed arrows in FIG. 14. The upstanding peripheral wall 114 is defined by end walls 115, 116 in generally parallel relationship to each other and side walls 117, 118, the latter of which includes an uppermost edge 121 and a lowermost edge 122. The wall 120 likewise includes opposite end walls 123, 124 and side walls 128, 130. The entire primary pan 13 is molded from thermoplastic polymeric/copolymeric material. Furthermore, during the molding thereof, the hot plastic/polymeric material has added thereto a preservative which functions to protect polymeric material from attack by microorganisms. Preferably, the preservative additive is either 2-n-octyl-4-isothiazolin-3-one and 10,10' bisphenoxarsine. When in use, the preservative prevents the formation of mildew, fungicides, bactericides or biocides and thereby maintains the aesthetic appearance of the convector tray 113, eliminates mildew odors, embrittlement, and premature product failure. (Obviously, the primary pan 13 of FIG. 1 might likewise be provided with such a preservative.)

In order to rigidify the primary pan 113, a reinforcing bar 130 of metallic material is riveted by rivets 131 to the exterior of the wall 118 while another reinforcing bar or member 132 is secured by rivets 133 to the interior of the side wall 117. The reinforcing bar 130 includes opposite ends 134, 135 each having an opening 137, 138, respectively, which functions as defined earlier relative to the openings 37, 38 (FIG. 3). Upper and lower longitudinal edges 141, 142 of the reinforcing bar 130 are in intimate sealing contact with the surfaces 121, 122 of the side wall 118 to effect longitudinal rigidity of the primary pan 113. The reinforcing bar 130 is in intimate sealing contact with the exterior surface (unnumbered) of the wall 118 as well as with the surfaces 121, 122 which prevents the formation of condensation therebetween and thus prevents the rivets 131 from being adversely affected (rusted). Normally the "hot" side of the primary pan 113 is below the bottom wall 126 while the "cool" side is above the bottom wall 126, and condensation occurs therebetween, as well as upon the primary coil. However, the "hot" and "cool" sides will create condensation upon the reinforcing bar 130, but not along those surfaces in sealing contact with the peripheral wall 118. Thus, the overall integrity of the primary pan 113 is in enhanced. A fastener 150 (FIG. 14) projects through each opening 127 and is covered by a cap or closure 151 (FIGS. 13 and 14). These caps or closures 151, as well as the caps or closures heretofore described relative to FIGS. 1 through 12, are also preferably formed of polymeric material admixed with a preservative to preclude the formation of fungicides, bactericides, etc.

A primary pan 113' of FIG. 15 is identical to the primary pan 113 except that a reinforcing bar 130+ does not include the upper flange 141 of FIG. 14. Instead the side wall 118' has a longitudinal lip 152 defining an abutment or sealing surface 153 with an upper free edge (unnumbered) of the reinforcing member 130'. The latter construction likewise effectively defines a seal between the abutting surfaces of the side wall 118' and the reinforcing member 130' to prevent condensation from adversely effecting rivets 131'.

Reference is now made to FIG. 16 which illustrates a primary pan 113''' identical in general aspects to the primary pan 113' but differing therefrom in that the reinforcing member 130'' is of a generally J-shaped cross sectional configuration which includes a lowermost leg 154 and an upwardly projecting flange 155 each in intimate clamping relationship to the side wall 118'''. Obviously, the lowermost leg 154 and the flange 155 establishes a seal with a surface (unnumbered) of the leg'' against which they abut, thereby forming a seal to prevent the formation of undesired condensation.

Reference is made to FIGS. 17–19 of the drawings which illustrate another primary pan, condensation pan or convector tray 160 defined by a bottom wall 161 and an upstanding peripheral wall 162 defined by opposite sidewalls 163, 164, a rear wall 165 and a front wall 166 (FIG. 19). Two generally rectangularly contoured upstanding walls 167, 168 define openings (unnumbered) through which air flows in the manner heretofore described. A discharge port 170 can be opened simply by drilling a hole through the bottom wall 161 in a conventional fashion. In addition, the bottom wall 161 includes a plurality of bosses 171, only one of which is illustrated, corresponding to the boss 83 of FIG. 10 with which is associated a cap 172 and fastening means 173 in the form of a nut and bolt for securing a motor mounting bracket 174 to the bottom wall 161 in a conventional fashion.

The primary pan 160 carries two rigid metal mounting/reinforcing bars 175, 176 associated with the respective walls 165, 166. Both of the reinforcing walls are generally of a C-shaped configuration. The reinforcing wall 175 is defined by a bight 177 and opposite generally opposing shoulders 178, 180 which are in opposing relationship to each other and terminate in outwardly curled terminal ends 181, 182. The reinforcing bar 175 is preferably constructed from relatively resilient metallic material, and thus the bar 175 can simply to snapped into the position shown in FIG. 19 by temporarily deflecting the terminal ends 181, 182 away from each other. The reinforcing bar 176 likewise includes a bight 183 and opposite opposing shoulders 184, 185 which have an overall length shorter than the bight 183 (FIG. 17) resulting in the bight 183 having opposite terminal end portions 186, 187 each having an aperture 188. The reinforcing bar 176 is made of relatively more rigid metallic material than that of the reinforcing bar 175, and thus the bar 176 must be slid upon the wall 166 to unite (or disunite) the same. However, once united the primary pan 160 is inserted into a housing 190, corresponding to the housing 11, with the shoulder 180 resting upon a plurality of tabs 191 integral with and struck from the material of a wall 192 of the housing 190. Fasteners are then inserted into the openings 188, just as in the case of the fasteners 41, 42, to secure the primary pan 160 relative to the housing 190.

Reference is made to FIGS. 20–22 of the drawings which illustrate another primary pan 195 corresponding to any one of the primary pans heretofore described and including a bottom wall 196 and a peripheral upstanding wall 197 to which is secured a rigid metal mounting-/reinforcing bar 200 by a series of rivets 201 or similar fasteners passing through openings 202 formed in an elongated main portion 203 of the reinforcing bar 200. The elongated main portion 203 terminates at one end in a mounting flange 204 and at an opposite end in another mounting flange 205 with the mounting flanges 204, 205 being disposed generally normal to each other and each having an opening 206 therein for receiving mounting fasteners, such as conventional sheet metal screws (not shown). An upper flange 207 is bent or folded back upon itself, as is best illustrated in FIG. 2, to impart rigidity over the entire length of the elongated main portion 203 and thus rigidify the entirety of the reinforcing bar 200 and, of course, the primary pan 195 rigidly secured thereto.

Figure 23:
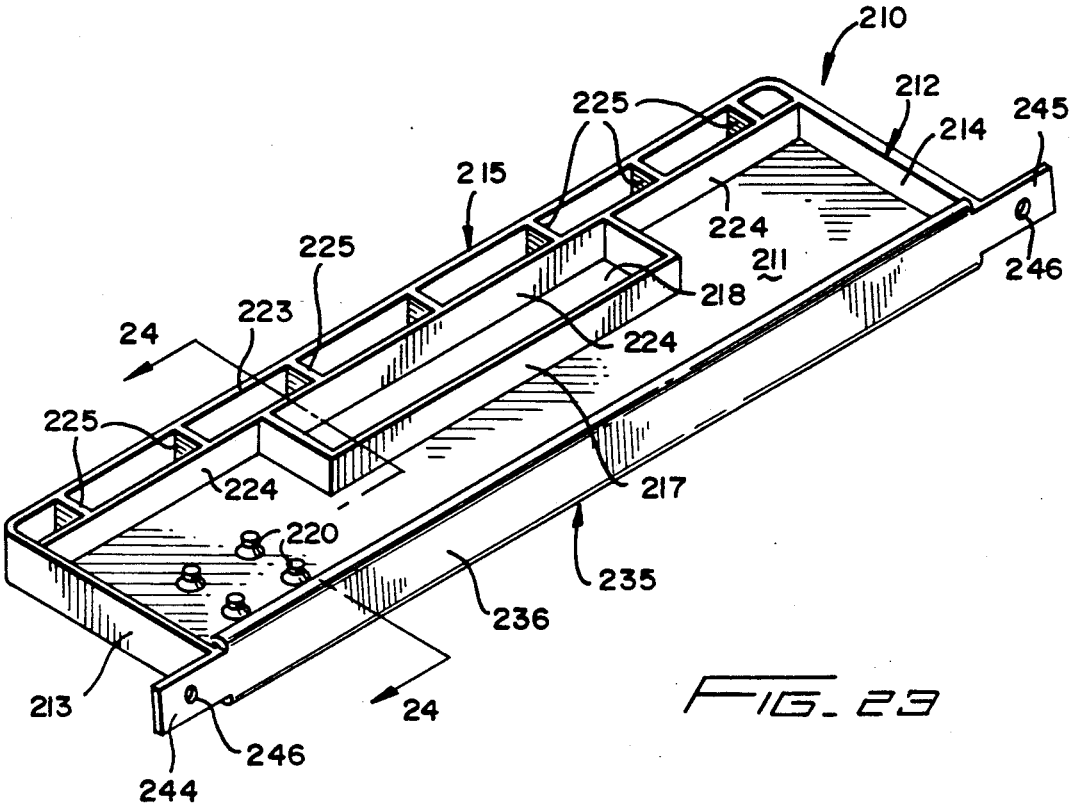
FIG. 23 is a top perspective view of another primary pan of the invention, and illustrates a metallic reinforcing bar secured to one wall of the primary pan, and an opposite wall of the primary pan being defined by a pair of walls in generally parallel side-by-side relationship reinforced by bosses in spanning relationship thereto.
Figure 24:
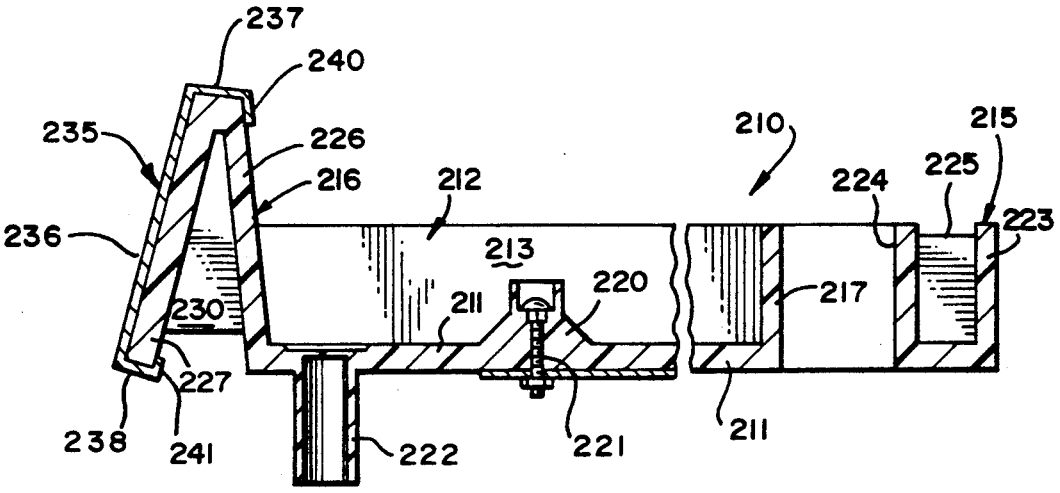
FIG. 24 is an enlarged fragmentary cross sectional view taken generally along line 24—24 of FIG. 23, and illustrates details of the primary pan and the metallic reinforcing bar thereof.

Another primary pan, convector tray or condensation pan is shown in FIGS. 23 and 24 of the drawings, and is generally designated by the reference numeral 210. The primary pan 210 includes a bottom w 11 211 and a peripheral wall 212 defined by opposite generally parallel side or end walls 213, 214, a rear wall 215 and a front wall 216. An inner generally polygonal upstanding wall 217 defines an opening 218 through the bottom wall 211, and the latter in turn includes several raised portions 220 corresponding to those heretofore described to accommodate motor mounting bolts or fastening means 221. A conventional discharge spout 222 forms an integral portion of the bottom wall 211.

The rear wall 215 is defined by two elongated wall portions 223, 224 extending in generally side-by-side parallel relationship to each other between the walls 212, 213. A plurality of integral bosses 225 span the distance between the elongated wall portions 223, 224 and effect rigidity therebetween along the entire length of the wall 215.

The front wall 216 is also defined by two generally elongated wall portions 226, 227 which are in upward converging and downward diverging relationship relative to the bottom wall 211 and which are likewise spanned by a plurality of bosses 230 corresponding to the bosses 225 which rigidify the elongated wall portions 227, 226 along the entire length thereof between the walls 213, 214. However, further rigidification of the front wall 216 is effected by a rigid metal mounting-/reinforcing bar 235 of a generally C-shaped configuration defined by a bight 236 and opposite shoulders 237, 238 terminating in respective terminal ends 240, 241. The bight portion 236 of the reinforcing bar 235 is foreshortened at opposite ends thereof resulting in the formation of flanges 244, 245 projecting beyond the respective walls 213, 214. The flanges 244, 245 have apertures or openings 246 for the receipt of fasteners, such as the fasteners 41, 42 of FIG. 1.

Figure 25:
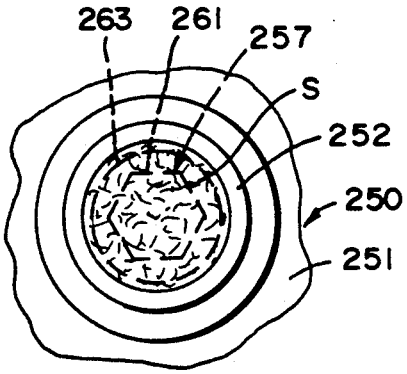
FIG. 25 is a fragmentary top plan view of a portion of a primary pan, and illustrates a raised portion of a bottom wall housing a motor mounting bolt.
Figure 26:
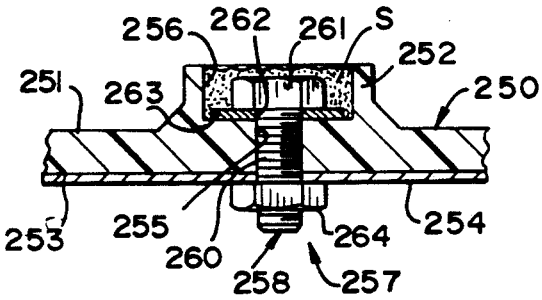
FIG. 26 is a fragmentary axial cross sectional view taken through the axis of FIG. 25, and illustrates a bolt, washer and nut securing a motor mounting bracket to the bottom wall of the pan and hot glue or silicone sealant material encapsulating the bolt head.

Reference is made to FIGS. 25 and 26 of the drawings in which a bottom wall 250 of a primary pan (unnumbered) is shown and includes an inner surface 251 from which rises an upstanding boss 252 and a bottom surface 253 to which is attached a metallic mounting bracket 254 corresponding to the motor mounting bracket 16 (FIG. 2). A bore 255 passes through the boss 252 and the bottom wall 250, and the upstanding boss 252 is also counterbored at 256. Fastening means 257 includes a bolt 258 having a threaded stem 260 and an enlarged head 261. The threaded stem 260 passes through an opening 262 of the washer 263 which is seated in the counterbore 256. A nut 264 rigidly connects the motor mounting bracket 254 to the bottom surface 253 of the bottom wall 250. In order to prevent the corrosive effect of condensation within the associated primary pan from adversely affecting the fastening means 257, the counterbore 256 is filled with hot glue or silicone sealing material S which covers the entirety of the bolt head 261 and the washer 263. Therefore, any condensation which might form inboard of the inner surface 251 of the bottom wall 250 will not gain access to and thus adversely affect the fastening means 257, and particularly the head 261 of the bolt 258 and the washer 263 associated therewith.

Figure 27:
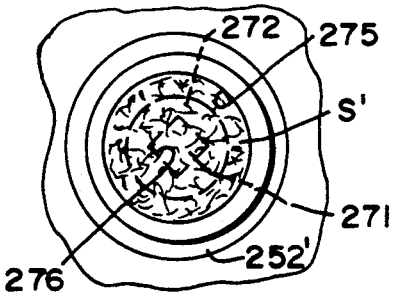
FIG. 27 is a fragmentary top plan view of another primary pan, and illustrates a raised portion housing a motor mounting carriage bolt.
Figure 28:
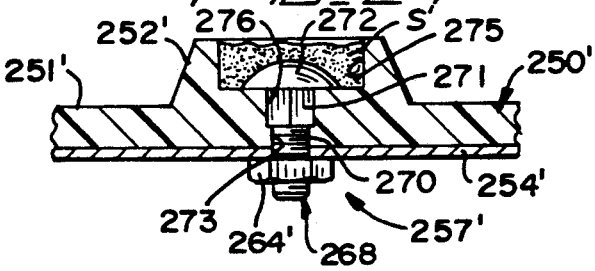
FIG. 28 is a fragmentary axial cross sectional view taken through the bolt of FIG. 27, and illustrates an oval head and polygonal neck thereof with the head being covered by a sealant.

Another arrangement similar to that shown in FIGS. 25 and 26 is illustrated in FIGS. 27 and 28, and identical structure therein bears identical though primed numerals. In this case the fastening means 257' includes a threaded bolt 268, but only a lower end portion 270 thereof is threaded. An upper portion 271 of the bolt 268 is of a polygonal or square configuration (FIG. 27) while a head 272 thereof is hemispherical, typical of a conventional carriage bolt. A bottom wall 250' is bored at 273, counterbored at 275, and provided with a polygonal recess 276 therebetween. The head 271 has a relatively broad bottom surface (unnumbered), and thus the weight of an associated motor is evenly distributed across the counterbore 275. Furthermore, the polygonal neck 271 matches the polygonal recess 276 and thus the bolt 268 will not rotate when an associated nut 264' is tightened or loosened relative to the threaded stem portion 270. Hot glue or silicone sealing material S' is also deposited in the counterbore 275 completely covering the hemispherical head 272 of the bolt 268.

Figure 29:
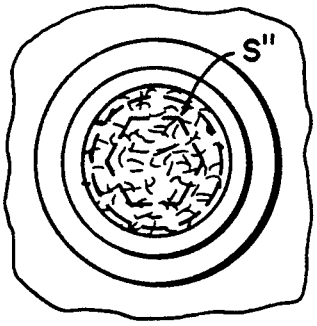
FIG. 29 is a fragmentary top plan view of another primary pan, and illustrates a mounting bolt for securing a motor bracket to a bottom wall of the pan.
Figure 30:
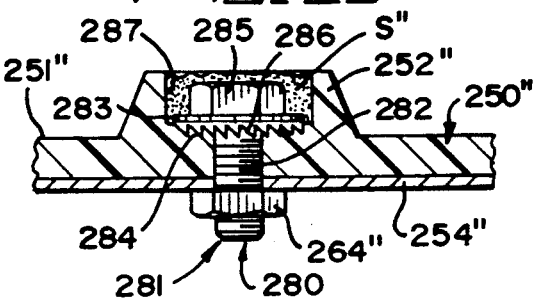
FIG. 30 is an axial cross sectional view taken through the bolt of FIG. 29, and illustrates an integral enlarged shoulder of the bolt having serrations meshing with serrations in a counterbore of the bottom wall to prevent counterclockwise unthreading motion of the bolt.

In FIGS. 29 and 30, fastening means 280 includes a bolt 281 having a threaded stem 282, a collar 283 having a plurality of downwardly directed cams or serrations 284 and a head 285. Serrations 286 form a bottom wall of a counterbore 287 of an upstanding boss 252'' of a bottom wall 250''. Silicone sealant or hot glue is inserted within the counterbore 287. The serrations 284, 286 permit clockwise rotation of the nut 281 but prevent counterclockwise rotation to assure that the fastening means 280 will not disassemble during continuous vibration inherent in motors and, of course, the motor mount 254'' associated therewith.

Figure 31:
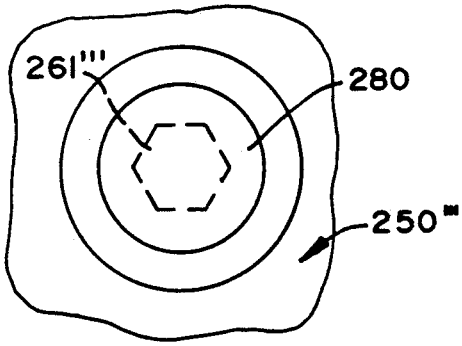
FIG. 31 is a fragmentary top plan view of another primary pan and its associated bolt, and illustrates a head of the bolt housed totally within a raised portion of the bottom wall.
Figure 32:
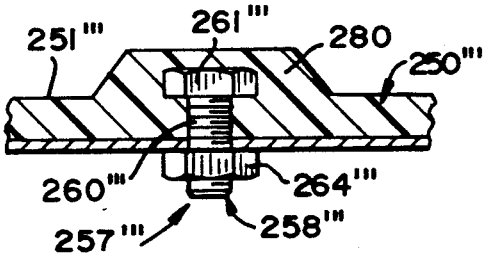
FIG. 32 is an axial cross sectional view taken through the bolt of FIG. 31, and illustrates the details of the bolt and threaded stem relative to a raised portion of the bottom wall.

Another fastening means 257''' is illustrated in FIGS. 31 and 32 associated with a bottom wall 250''' of a convector tray (unnumbered). A raised boss 280 entirely encapsulates a head 261''' of a bolt 258''' thereby assuring that the bolt 258''' will not rotate when a nut 264''' is rotated relative to a threaded stem 260''' of the bolt 258'''. Preferably the bolt is embedded in the boss 280 during the in situ injection molding of the primary pan.

Although a preferred embodiment of the invention has been specifically illustrated and described herein, it is to be understood that minor variations may be made in the apparatus without departing from the spirit and scope of the invention as defined in the appended claims.

I claim:

1. A primary pan comprising a pan body including a bottom wall and an upstanding peripheral wall collectively defining a condensation chamber, said bottom wall having an inner surface, at least one motor mount in the form of a raised portion of said bottom wall projecting above said inner surface, a bore through said motor mount and a bottom wall generally normal to the latter, said bore including a counterbored portion, a fastener having a stem inserted into said bore and an enlarged portion seated in said counterbored portion, and a sealant disposed in said counterbored portion over said fastener enlarged portion to thereby prevent condensation from damaging said fastener.

2. The primary pan as defined in claim 1 wherein said enlarged portion is a head of said fastener.

3. The primary pan as defined in claim 1 wherein said enlarged portion is a polygonally contoured neck of said fastener, and said counterbored portion matches the configuration of said contoured neck whereby rotation of said fastener relative to said bore is precluded.

4. The primary pan as defined in claim 1 wherein said fastener is a cage bolt and said enlarged portion is a head of said cage bolt.

5. The primary pan as defined in claim 1 including an enlarged washer carried by said stem and housed within said counterbored portion.

6. The primary pan as defined in claim 1 including a plurality of serrations at an underside of said enlarged portion in gripping contact with an opposing surface of said counterbored portion.

7. The primary pan as defined in claim 1 including a polygonally contoured recess portion between said bore and said counterbored portion, said enlarged portion being a head of said fastener, said fastener having a polygonally contoured neck portion matching said polygonally contoured recess portion, and said neck portion being seated in said recess portion.

8. The primary pan as defined in claim 6 wherein said serrations are cams which permit clockwise rotation of said fastener relative to said opposing surface and resist counterclockwise rotation of said fastener relative to said opposing surface.

9. A primary pan comprising a pan body including a bottom wall and an upstanding peripheral wall collectively defining a condensation chamber, said bottom wall having an inner surface and an outer surface at least one motor mount in the form of a raised portion of one of said inner and outer bottom wall surfaces, a bolt having a stem and an enlarged head, and said head being in situ molded within said raised portion with only said stem projecting beyond said bottom wall.

10. The primary pan as defined in claim 9 wherein said one surface is said inner bottom wall surface.

11. The primary pan as defined in claim 9 wherein said stem projects through said outer bottom wall surface.

12. The primary pan as defined in claim 11 wherein said one surface is said inner bottom wall surface.

* * * * *